US011188028B2

(12) United States Patent
Boaron et al.

(10) Patent No.: US 11,188,028 B2
(45) Date of Patent: Nov. 30, 2021

(54) BUTTON FOR A TIMEPIECE

(71) Applicant: ROLEX SA, Geneva (CH)

(72) Inventors: Nicolas Boaron, Founex (CH); Pedro Manuel Dos Santos Pedrosa, Prévessin-Moens (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/848,810

(22) Filed: Dec. 20, 2017

(65) Prior Publication Data

US 2018/0181068 A1 Jun. 28, 2018

(30) Foreign Application Priority Data

Dec. 23, 2016 (EP) ..... 16206881

(51) Int. Cl.
*H01H 13/14* (2006.01)
*G04B 3/04* (2006.01)
*G04B 37/10* (2006.01)

(52) U.S. Cl.
CPC ..... *G04B 3/048* (2013.01); *G04B 37/106* (2013.01)

(58) Field of Classification Search
CPC ..... H01H 13/14; H01H 13/04; H01H 13/50; H01H 3/12; H01H 13/20; H01H 13/705; H01H 25/008; H01H 13/28; G04B 3/041; G04B 3/04; G04B 37/08; G04B 37/106; G04B 3/046; G04B 3/048; G04B 3/006; G04B 37/005; G04B 37/084
See application file for complete search history.

(56) References Cited

U.S. PATENT DOCUMENTS

| | | | | |
|---|---|---|---|---|
| 4,408,901 | A | 10/1983 | Gagnebin | |
| 8,971,156 | B2 * | 3/2015 | El Kadiri | G04B 3/043 368/69 |
| 2014/0177404 | A1 | 6/2014 | Briswalter et al. | |
| 2015/0228424 | A1 * | 8/2015 | Tallone | H01H 13/28 200/513 |
| 2016/0259300 | A1 | 9/2016 | Bentrim | |

FOREIGN PATENT DOCUMENTS

| | | | |
|---|---|---|---|
| CH | 350249 | A | 11/1960 |
| CH | 616 548 | A3 | 4/1980 |
| CH | 708 958 | A2 | 6/2015 |
| EP | 0 030 696 | A1 | 6/1981 |
| EP | 0 575 831 | A1 | 12/1993 |
| EP | 2 746 873 | A1 | 6/2014 |
| FR | 2 919 078 | A1 | 1/2009 |
| WO | 2016/141146 | A1 | 9/2016 |

OTHER PUBLICATIONS

European Search Report and Written Opinion dated Aug. 10, 2017 issued in counterpart application No. EP16206881; w/ English machine translation (13 pages).

* cited by examiner

*Primary Examiner* — Ahmed M Saeed
(74) *Attorney, Agent, or Firm* — Westerman, Hattori, Daniels & Adrian, LLC

(57) ABSTRACT

A button (1) for a timepiece, comprising:—a rod (4);—a tube (2) for guiding of the rod (4) along a longitudinal axis (A);—a ring (3); and—a mechanical connection (3*d*, 2*c*, 5) between the ring and the tube, the mechanical connection being of the bayonet type and/or comprising a spring (5).

19 Claims, 5 Drawing Sheets

BUTTON FOR A TIMEPIECE

This application claims priority of European patent application No. EP16206881.1 filed Dec. 23, 2016, which is hereby incorporated herein in its entirety.

The invention relates to a button or push button of a timepiece or for a timepiece. The invention also relates to a middle device comprising a button of this type. The invention further relates to a watch case comprising a middle device of this type or a button of this type. The invention also relates to a timepiece comprising a middle device of this type or a button of this type or a watch case of this type. Finally, the invention relates to a process for fitting a button of this type and a process for removal of a button of this type.

A push button is known from document EP0030696 which is provided with a tube driven into a watch case middle. A rod, on which a gasket is fitted, is accommodated in the tube such as to constitute a function corrector, which is displaceable in translation. The rod is simply delimited axially relative to the tube by means of a channel formed in the inner wall of the tube, which channel is designed to receive the gasket, in particular in the event of an impact. This solution for assembly of the rod is not satisfactory in that it can allow untimely removal of the rod from the tube when the watch case is being worn, in particular in the event of a strong impact. In addition, this push button structure can be problematic if an operation of maintenance of the watch case requires the removal of the tube from the middle, or for example if the state of the tube requires it to be replaced. A structure of this type is therefore not satisfactory.

A push button is known from document CH616548, which is provided with a threaded tube designed to be screwed into a watch case middle. A rod, on which a gasket is fitted, is in particular accommodated in the tube, such as to constitute a function corrector, which is displaceable in translation. This rod is delimited axially relative to the tube by means of a button head, one end of which is driven into the barrel of the button head. Thus, if the push button can be unscrewed from the middle by means of a collar formed on the outer periphery of the tube, the functional elements of the push button, such as the rod and its return spring, as well as the gasket, cannot be easily removed from the tube. In particular, there are risks of marking the head of the push button during the drawing-out operation. A structure of this type is therefore not optimal.

A push button is known from document EP0575831, which is provided with a tube welded onto a watch case middle. A rod, on which a gasket is fitted, is in particular accommodated in the tube, such as to constitute a function corrector, which is displaceable in translation. In a first direction of translation of the rod, the rod is delimited axially by means of a portion of rod designed to abut a surface formed at the end of the tube. In a second direction of translation of the rod, the rod is delimited axially by means of a portion of rod which is designed to abut a surface formed at the end of a ring added inside the tube. According to the different variant embodiments described, the ring is either in the form of a threaded ring designed to be screwed into a tapped portion of the tube, or in the complex form of a disc retained axially by an additional resilient ring. This document does not give any indication concerning the implementation of a push button, which can be dismantled entirely from the watch case. In the hypothesis when the tube is connected to the middle in a manner which can be dismantled, a simple connection which can be dismantled must be defined between the stopper and the tube, which connection is easy to actuate, and without detracting from the assembly of the tube in the middle.

The objective of the invention is to provide a timepiece button which makes it possible to eliminate the disadvantages previously mentioned, and to improve the timepiece buttons known in the prior art. In particular the invention proposes a button which can be easily and completely dismantled from the middle of the watch case on which the push button is fitted. The button itself must be possible to dismantle easily and completely.

A button according to the invention is defined by point 1 or by point 2 below.

1. A button for a timepiece comprising:
   a rod;
   a tube to guide the rod along a longitudinal axis;
   a ring; and
   a mechanical connection between the ring and the tube, the mechanical connection being of the bayonet type, and/or comprising a spring.
2. The button for a timepiece comprising:
   a rod;
   a tube to guide the rod along a longitudinal axis;
   a ring;
   a spring; and
   a mechanical connection of the bayonet type between the ring and the tube.

Different embodiments of the button are defined by points 3 to 11 below.

3. The button as defined in one of the preceding points, wherein the spring is a helical spring and/or a spring for return of the rod to a position of rest.
4. The button as defined in one of the preceding points, wherein:
   the mechanical connection comprises at least one, preferably two, three or four protuberances extending radially on the tube, in particular radially towards the inside of the tube, and/or towards the outside of the tube, relative to the longitudinal axis, and comprises at least one, preferably two, three or four housings in the ring, the housings each being designed to receive a protuberance; and/or
   the mechanical connection of the bayonet type comprises at least one, preferably two, three or four protuberances which extend on the ring radially, in particular radially towards the inside of the ring and/or towards the outside of the ring, relative to the longitudinal axis, and comprises at least one, preferably two, three or four housings in the tube, the housings each being designed to receive a protuberance.
5. The button as defined in one of the preceding points, wherein the mechanical connection comprises at least one first axial stop, provided on the tube, and at least one second axial stop, provided on the ring, the first and second axial stops being designed to cooperate in the form of an obstacle in order to stop the ring in axial translation along the longitudinal axis relative to the tube.
6. The button as defined in one of the preceding points, wherein the mechanical connection comprises at least one first lateral stop, preferably at least two first lateral stops, provided on the tube, and at least one second lateral stop, preferably at least two second lateral stops, provided on the ring, the first and second lateral stops being designed to cooperate in the form of an obstacle in order to stop the ring in rotation according to the longitudinal axis, relative to the tube, in at least one direction of rotation.
7. The button as defined in points 5 and 6, wherein the at least one first lateral stop comprises at least one rim which extends along the longitudinal axis from a first axial stop, or wherein the at least one second lateral stop comprises at least one rim which extends along the longitudinal axis, from a second axial stop.

8. The button as defined in one of the preceding points, wherein the tube comprises three first axial stops each extending over an angular sector of between 30° and 50° around the longitudinal axis, and/or wherein the tube comprises three first axial stops distributed angularly regularly around the longitudinal axis, and/or wherein the ring comprises three second axial stops each extending over an angular sector of between 30° and 50° around the longitudinal axis, and/or wherein the ring comprises three second axial stops distributed angularly regularly around the longitudinal axis.

9. The button as defined in one of the preceding points, wherein the tube comprises an outer thread which is designed to allow it to be screwed into a middle, and/or the tube comprises an annular groove for accommodation of a gasket, and/or wherein the tube comprises a shape, in particular a bore with a non-circular cross-section, in particular which is polygonal or has a splined or toothed cross-section, designed to allow the tube to be rotated by means of a tool with a shape which is substantially complementary to the shape, and/or wherein the tube comprises at least one first guide surface, and the ring comprises at least one second guide surface, the first and second surfaces cooperating in order to guide the ring in the tube in sliding pivot connection.

10. The button as defined in one of the preceding points, wherein the ring comprises a bore for guiding the rod.

11. The button as defined in one of the preceding points, wherein the ring comprises a face provided with at least one indentation, in particular two, three or four indentations, in particular two, three or four hollow indentations, designed to receive a tool for displacement of the ring relative to the tube, in particular a tool for displacement along the longitudinal axis in translation and/or in rotation of the ring relative to the tube.

A middle device according to the invention is defined by point 12 below.

12. A middle device of a watch case comprising a button as defined in one of the preceding points.

A watch case according to the invention is defined by point 13 below.

13. A watch case comprising a middle as defined in the preceding point, or a button as defined in one of points 1 to 11.

A timepiece according to the invention is defined by point 14 below.

14. A timepiece, in particular a wristwatch, comprising a watch case as defined in the preceding point, or a middle device as defined in point 12, or a button as defined in one of points 1 to 11.

A process for assembly of a button according to the invention is defined by point 15 below.

15. A process for fitting or assembling a button as defined in one of points 1 to 11, the process comprising the following steps:

providing a rod, a tube for guiding of the rod along a longitudinal axis and a spring, in particular a spring for return of the rod to a position of rest;

providing a ring;

introducing the ring into the tube or the tube into the ring by exerting an axial force, in particular an axial force which opposes a force produced by the spring;

turning the ring relative to the tube by a fraction of a turn around the longitudinal axis in particular whilst maintaining the axial force;

releasing the axial force.

A process for dismantling a button according to the invention is defined by point 16 below.

16. The process for fitting or assembling a button as defined in one of points 1 to 11, the process comprising the following steps:

turning the ring relative to the tube by a fraction of a turn around the longitudinal axis in particular whilst applying an axial force or after having applied an axial force;

releasing the axial force.

The appended figures represent by way of example an embodiment of a timepiece according to the invention.

Figure 1:
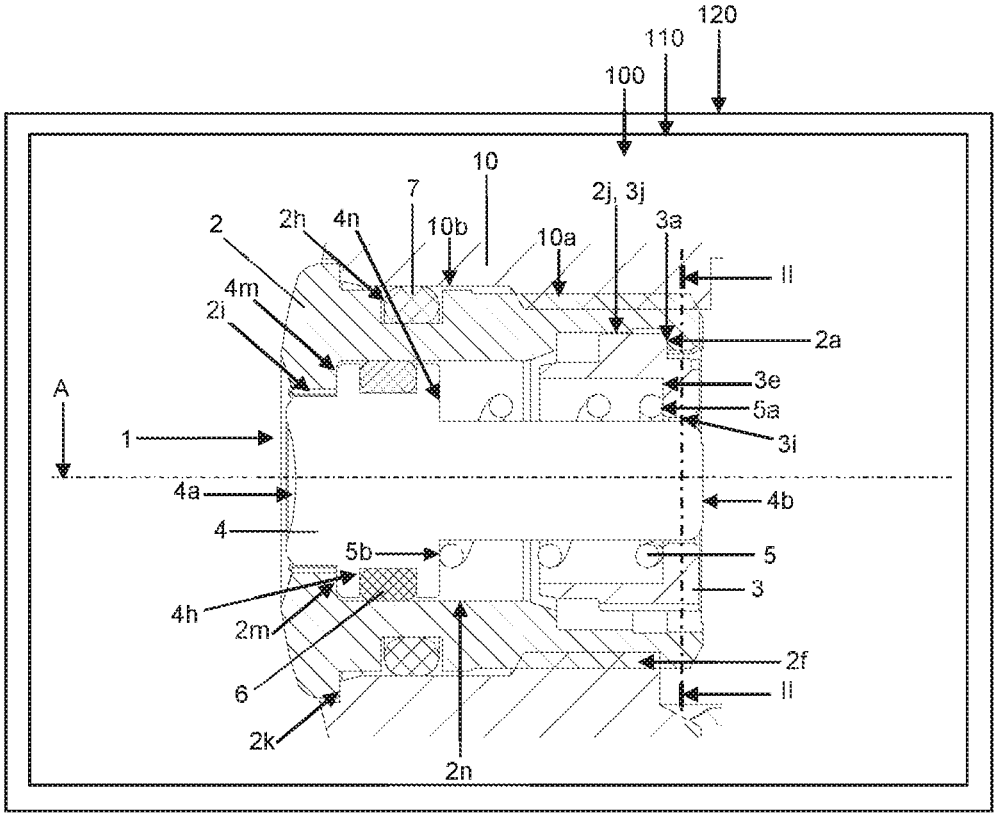
FIG. 1 is a schematic view of an embodiment of a timepiece according to the invention comprising an embodiment of a button.
Figure 2:
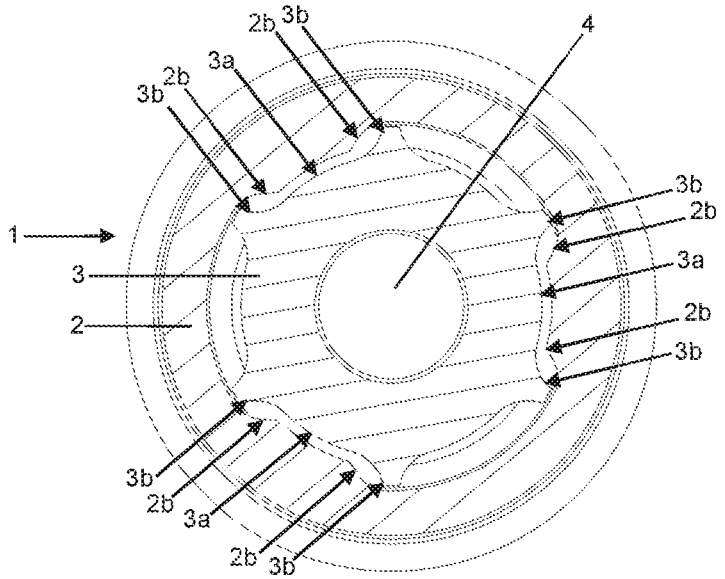
FIG. 2 is a view in transverse cross-section of the embodiment of the button according to the plane II-II in FIG. 1.

An embodiment of a timepiece 120 is described hereinafter with reference to FIGS. 1 to 10. The timepiece is for example a watch, in particular a wristwatch. The timepiece can comprise a mechanical movement or an electronic movement. The timepiece comprises an embodiment of a watch case 110 which accommodates the movement.

The watch case 110 comprises an embodiment of a middle device 100.

The middle device 100 comprises a middle 10 itself comprising an embodiment of a button 1 or push button 1. The button permits transmission of an action by a user or a tool to an element inside the middle device or inside the watch case, in particular to the timepiece movement assembled in the watch case. The button makes it possible for example to transmit a command for adjustment or correction or activation or deactivation of a timepiece movement function. In particular, the button can transmit a command for adjustment or correction or activation or deactivation of one or a plurality of timepiece functions. The button can thus for example constitute or form part of a corrector, which permits the adjustment of time indications or time derivatives of a timepiece.

The embodiment of the button 1 is described hereinafter with reference to FIGS. 1 to 10.

The button comprises:

a rod 4;

a tube 2 to guide the rod 4 along a longitudinal axis A;

a ring 3; and a mechanical connection 3*d*, 2*c* between the ring and the tube.

Preferably, the button also comprises a spring 5.

Preferably, the mechanical connection between the ring and the tube is of a bayonet type, and/or the mechanical connection comprises a spring 5.

Preferably, the tube has a form which is at least substantially cylindrical of revolution with a longitudinal axis A.

The tube is designed to be attached to the middle. The tube has for example at one of its outer ends an outer thread 2*f* which is designed to allow it to be screwed into the middle 10. For this purpose, the middle 10 has a bore 10*b* provided with tapping 10*a* which is designed to cooperate with the outer thread 2*f*.

At the other one of its outer ends, the tube has a bearing surface 2*k* which is designed to be supported against the middle 10, in particular against a countersink provided in the middle, when the tube is screwed down completely into the middle.

Between its outer ends, the tube has an annular groove 2*h* for accommodation of a gasket 7. The gasket 7 is designed to be supported against the bore 10*b* in order to provide sealing at the tube-middle interface. The gasket is of the annular type. The gasket can be an O-ring seal and/or an elastomer gasket.

At one of its inner ends, the tube has a bearing surface 2*m* which is designed to constitute a stop for displacement of the rod.

Figure 4:
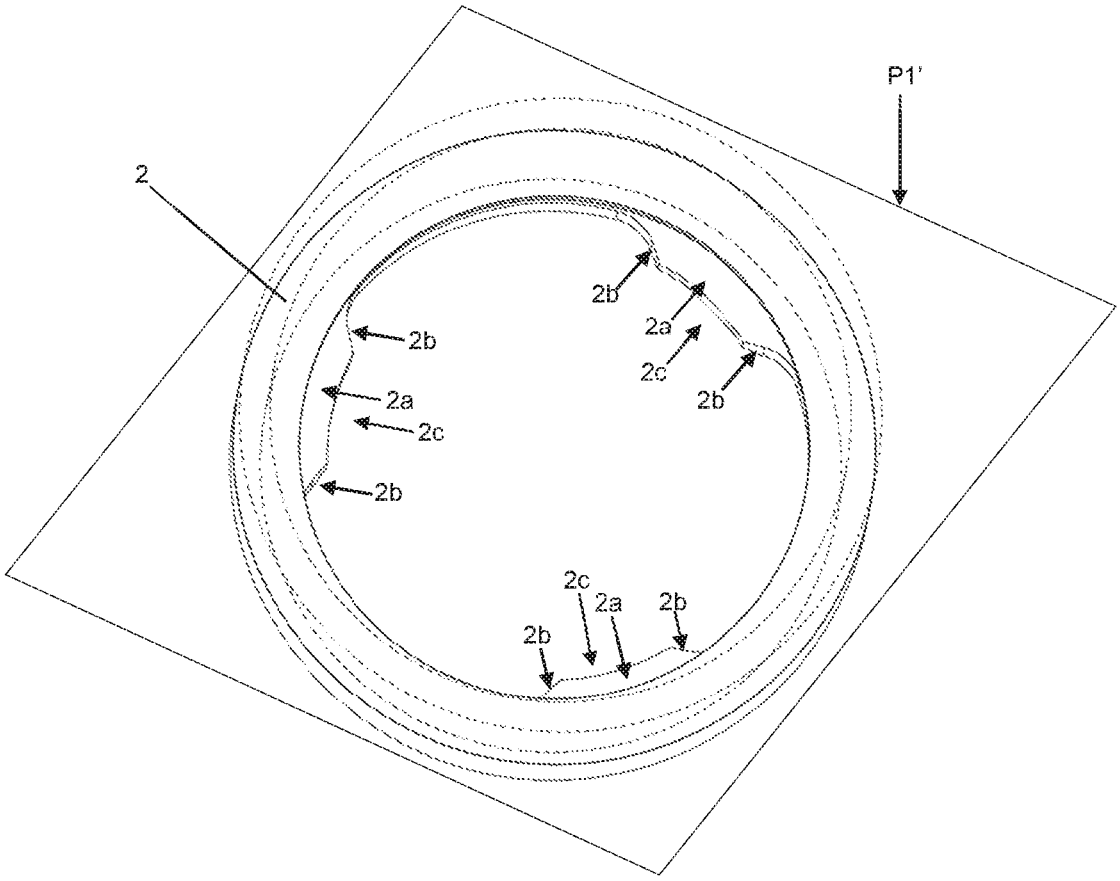
FIG. 4 is a view in perspective of a tube of the embodiment of the button.
Figure 5:
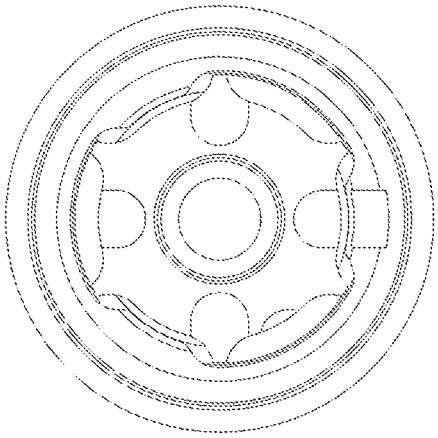
FIGS. 5 to 9 are views of the embodiment of the button in different steps of its assembly process.

At the other one of its inner ends, the tube has connection elements 2*a*, 2*b*, 2*c* of the bayonet connection type, which are described hereinafter, in particular with reference to FIG. 4. In the embodiment represented, the tube 2 comprises three protuberances 2*c* which constitute the main elements of the mechanical connection of a bayonet type on the tube.

The tube makes it possible to guide the rod in translation along the longitudinal axis A. For this purpose, the tube has a bore 2*n* for guiding of the rod.

The tube advantageously comprises a shape 2*i*, in particular a cut-out with a non-circular cross-section, in particular which is polygonal or has a splined cross-section or toothed cross-section, designed to allow the tube to be rotated by means of a tool with a shape which is at least substantially complementary to the shape 2*i*. This shape is preferably a cut-out which can be provided at the end which is in the vicinity of the outer surface of the middle, as in the embodiment represented.

Alternatively, the shape can be provided at the end of the tube which is mounted in the middle, and/or the shape can be arranged on the outer periphery of the tube.

The tube also comprises at least one first guide surface 2*j*, in particular a bore, which is designed to cooperate with a second guide surface 3*j*, in particular a cylindrical surface. The first and second guide surfaces cooperate in order to guide the ring in the tube in sliding pivot connection.

The ring 3 has a substantially annular form.

The ring 3 makes it possible mainly to provide a support for the spring 5. For this purpose, the ring comprises a bearing surface 3*e*, in particular a bearing surface 3*e* in a bore.

The ring 3 also preferably comprises a bore 3*i* for guiding of the rod 4.

Figure 3:
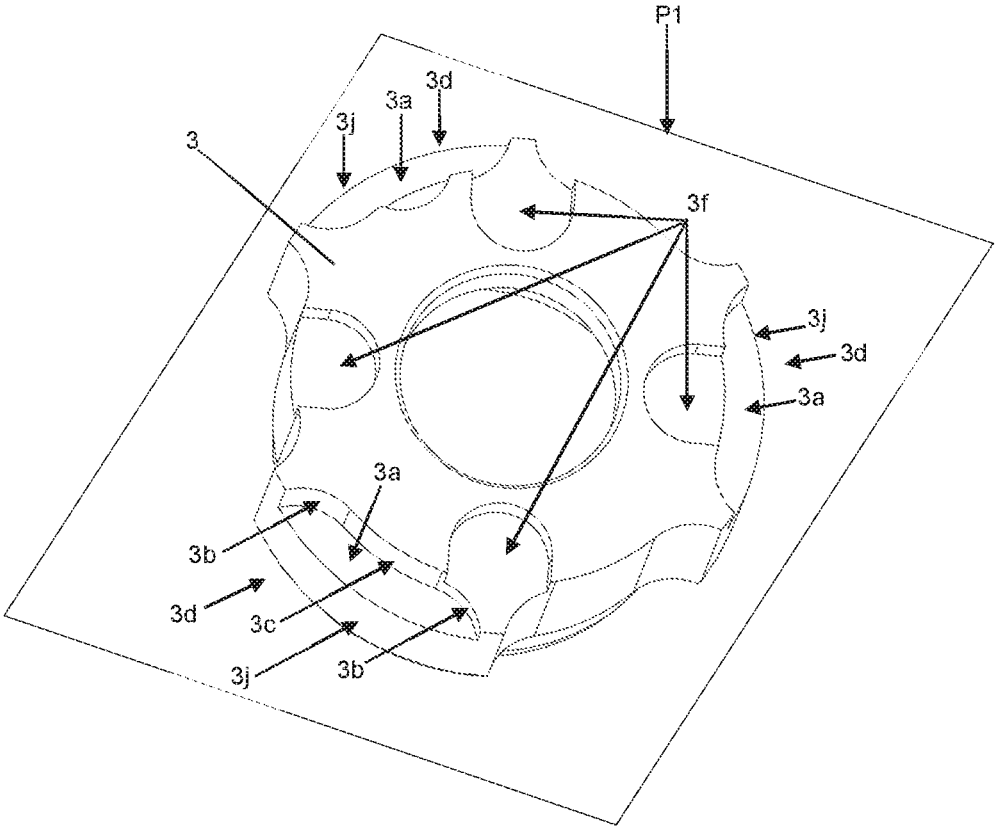
FIG. 3 is a view in perspective of a ring of the embodiment of the button.

Finally, the ring comprises connection elements 3*a*, 3*b*, 3*c*, 3*d* of a bayonet type, which are described hereinafter, in particular with reference to FIG. 3. These elements cooperate with the connection elements 2*a*, 2*b*, 2*c* which are provided on the tube. In the embodiment represented, the ring 3 has a trilobe geometry. It comprises three lobes 3*d* each provided with a housing 3*d* constituting the main mechanical connection elements of a bayonet type on the ring. The housings 3*d* cooperate with the protuberances in order to constitute the connection of a bayonet type.

In addition, the ring advantageously comprises a face, in particular a face which can be seen from the inside of the watch case, provided with at least one indentation 3*f* designed to receive a tool for displacement of the ring relative to the tube. The at least one indentation and the tool are formed such that a timepiece can exert mechanical actions on the ring. In particular, the at least one indentation and the tool are formed such that a timepiece can push the ring along the longitudinal axis A, and such that it can rotate the ring around the longitudinal axis A. Thus, the mechanical actions are such as to permit the displacement of the ring relative to the tube in translation along the axis A, and/or the displacement of the ring relative to the tube in rotation around the axis A.

The ring preferably comprises two, three or four indentations 3*f*. Advantageously, the at least one indentation 3*f* is a hollow indentation. In the embodiment represented, four hollow indentations or notches 3*f* are provided, as represented in FIG. 3.

The rod 4 represents globally a cylindrical geometry of revolution around the longitudinal axis A.

The rod has a first bearing surface 4*n* which is designed to constitute a support surface for the spring 5, in particular an end 5*b* of the spring 5.

The rod has a second bearing surface 4*m* which is designed to cooperate with the bearing surface 2*m*, provided on the tube, in order to stop the rod in translation along the longitudinal axis A. When the two bearing surfaces are in contact, as in FIG. 1, the rod is in a position of rest.

Between the first and second bearing surfaces, the rod comprises an annular groove 4*h* for accommodation of a gasket 6. The gasket 6 is designed to be supported against the bore 2*n*, in order to provide sealing at the tube-rod interface. The gasket is of the annular type. The gasket can be an O-ring gasket and/or an elastomer gasket.

In addition, the rod 4 comprises a first end 4*a* which is designed to interact with the user of the push button directly, or by means of a tool. The first end 4*a* can extend from the tube, so that the user can act directly on this end. Alternatively, the first end can be flush with the end of the tube, or it can also be slightly recessed from the end of the tube as represented. In this case, the first end 4*a* can have a concave cut-out, such as to facilitate the action of a tool. This form is used for example to act on a corrector.

The rod 4 comprises a second end 4*b* which is designed to come into contact with the movement, in particular with a component of the movement, and to act on the latter when the rod is displaced in translation along the longitudinal axis A.

As previously stated, the button comprises a spring 5. The spring 5 is advantageously a helical spring. The first end 5*a* of the spring is supported against the bearing surface 3*e* of the ring on the one hand, and the second end 5*b* of the spring is supported against the bearing surface 4*n* of the rod on the other hand. Thus, the spring 5 is supported on the ring 3 and on the rod 4, such as to return the rod to its position of rest represented in FIG. 1, i.e. with the surfaces 2*m* and 4*m* in contact with one another. Preferably, the spring is pre-compressed between the surfaces 4*n* and 3*e*. In this case, the spring 5 provides two functions. The spring provides a function of mechanical connection as described hereinafter. The spring also provides a function of return of the rod to its position of rest.

The rod can thus be displaced, under the action of the user, in translation along the longitudinal axis A, against the spring 5, such that the end 4*b* of the rod can interact for example with a component of the movement of the timepiece. The rod returns to position in a conventional manner under the effect of the return of the return spring 5.

Globally, the ring 3 is fitted in the tube 2, such that the ring and the tube encapsulate the functional elements of the button, in particular the rod 4, the return spring 5 of the rod 4, and the gasket 6.

"Mechanical connection of a bayonet type" preferably means a connection which permits assembly of a first part on a second part, and/or dismantling of the first part from the second part in accordance with the following sequence of steps:

pushing the first part relative to the second part, in particular against the action of a spring;

turning the first part relative to the second part by a fraction of a turn, i.e. less than one turn, whilst continuing or not continuing to push the first part relative to the second part, in particular against the action of a spring;

ceasing to push.

During the dismantling, the step "pushing the first part relative to the second part, in particular against the action of a spring" can be optional.

According to a first variant, the mechanical connection comprises at least one, preferably two, three or four protuberances 2*c* on the tube. The protuberances extend radially, in particular radially towards the inside of the tube, relative to the longitudinal axis A. The mechanical connection comprises at least one, preferably two, three or four housings 3*d* in the ring. Each housing is designed to receive a protuberance. In the embodiment represented, the tube 2 has three protuberances 2*c* which extend radially towards the inside of the tube, relative to the longitudinal axis A, and the ring 3 has three housings 3*d*.

According to a second variant, the mechanical connection comprises at least one, preferably two, three or four protuberances on the tube. The protuberances extend radially, in particular radially towards the outside of the tube, relative to the longitudinal axis. The mechanical connection comprises at least one, preferably two, three or four housings in the tube, the housings each being designed to receive a protuberance.

As an alternative to these two variants, the at least one protuberance can be provided on the ring, and can cooperate with the at least one housing provided in the tube.

The mechanical connection comprises at least one first axial stop 2*a*, provided on the tube, and at least one second axial stop 3*a*, provided on the ring. The first and second axial stops are designed to cooperate in the form of an obstacle in order to stop the ring in axial translation along the longitudinal axis A relative to the tube. The spring 5 places the first axial stops and the second axial stops against one another.

In the embodiment represented, three first stops 3*a* are constituted by surfaces of the housings 3*d*. In particular, these surfaces can be portions, in particular annular portions, of planes perpendicular to the longitudinal axis A, in particular annular portions of a plane perpendicular to the longitudinal axis A. Three second stops 2*a* are constituted by surfaces of the protuberances 2*c*. In particular, these surfaces can be portions, in particular annular portions, of planes perpendicular to the longitudinal axis A, in particular annular portions of a plane P1' perpendicular to the longitudinal axis A.

As a variant, the at least one first axial stop 2*a* and the at least one second axial stop 3*a* need not be flat. They are preferably complementary. The at least one first axial stop 2*a* and the at least one second axial stop 3*a* can have helical surfaces.

The mechanical connection comprises the spring 5. The spring makes it possible to return the at least one first axial stop 2*a* against the at least one second axial stop 3*a*. When the ring 3 is assembled inside the tube 2, the surfaces 3*a* of the ring 3 are thus supported against surfaces 2*a* of the tube 2 under the effect of the presser force of the spring 5.

According to an embodiment not represented, the spring could be supported against the surface 3*e* and against a bearing surface in the bore in the tube. In this case, the spring is not supported against the rod. Thus, the spring has only a function of assembly of the ring on the tube, and in particular the function of returning the at least one first axial stop 2*a* against the at least one second axial stop 3*a*. In this embodiment, the rod is returned to its position of rest by another spring. This other spring can be provided in the button or in the timepiece movement.

The three first axial stops 2*a* preferably each extend over an angular sector of between 30° and 50° around the longitudinal axis A, and the three second axial stops 3*a* each extend over an angular sector of between 30° and 50° around the longitudinal axis A.

The first axial stops 2*a* are advantageously distributed angularly regularly around the longitudinal axis A. Similarly, the second axial stops 3*a* are advantageously distributed angularly regularly around the longitudinal axis A.

The mechanical connection comprises at least one first lateral stop 2*b*, preferably at least two first lateral stops 2*b*, provided on the tube, and at least one second lateral stop 3*b*, preferably at least two second lateral stops 3*b*, provided on the ring. The first and second lateral stops are designed to cooperate in the form of an obstacle in order to stop the ring in rotation around the longitudinal axis A, relative to the tube, in at least one direction of rotation, preferably in both directions of rotation. Thus, the swinging in rotation of the ring 3 inside the tube 2 is delimited.

The at least one second lateral stop 3*b* can comprise or be constituted by at least one rim 3*b* which extends along the longitudinal axis A from a second axial stop 3*a*. Preferably, each second lateral stop 3*b* comprises a rim 3*b* which extends along the longitudinal axis A, from a second axial stop 3*a*. Also preferably, the second lateral stops 3*b* comprise or are constituted by two rims 3*b* which extend along the longitudinal axis A from each second axial stop 3*a* as represented in FIG. 3. Preferably, the lateral stops are rims which are provided at housings 3*d*. The second lateral stops cooperate with first lateral stops 2*b* constituted by lateral walls of the protuberances 2*c*.

Alternatively, the at least one first lateral stop 2*b* comprises at least one rim which extends along the longitudinal axis from a first axial stop 2*a*.

"Rim" preferably means a shape in the form of a relief or bump formed on an axial stop surface or from an axial stop surface.

As a variant, at least one first axial stop 2*a* can have a concave surface, and at least one second axial stop 3*a* can have a convex surface. The concave and convex surfaces are preferably complementary or substantially complementary.

As a variant, the at least one first axial stop 2*a* can have a convex surface, and the at least one second axial stop 3*a* can have a concave surface. The concave and convex surfaces are preferably complementary or substantially complementary.

In the case of these two variants, the lateral stops can be omitted. In fact, when the first and second axial stops are in contact, torque opposes the rotation of the ring relative to the tube, since this rotation involves compression of the spring which ensures the return of the first and second axial stops against one another.

The part 2 or 3 comprising the housings can have guide channels for the protuberances of the other part 3 or 2, these channels being arranged such as to guide the protuberances between the housings and an end of the part comprising the housings.

Preferably, the protuberances and/or the housings are obtained by removal of material.

An embodiment of a process for fitting or assembly of a button is described hereinafter.

Figure 6:
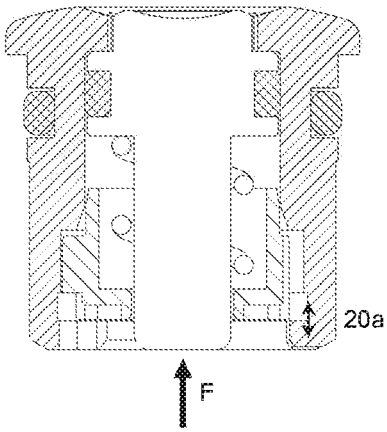
Figure 7:
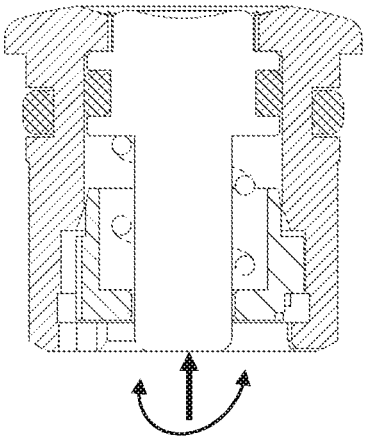
Figure 8:
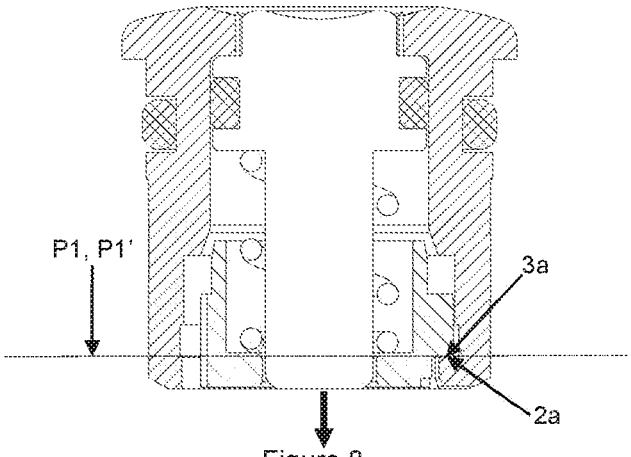

The process comprises the following steps:

providing a rod 4, a tube 2 for guiding of the rod 4 and a spring 5, in particular a spring for return of the rod;

introducing the rod 4 and the spring into the guide tube 2 along the longitudinal axis A;

providing a ring 3;

introducing the ring into the tube or the tube into the ring by exerting an axial force F, in particular an axial force F which opposes a force produced by the spring 5 (FIG. 6);

turning the ring relative to the tube by a fraction of a turn around the longitudinal axis A whilst maintaining or not maintaining the axial force (FIG. 7);

releasing the axial force (FIG. 8).

In the third assembly step, the ring 3 is arranged opposite the tube 2, such that the housings 3*d* are situated between two protuberances 2*c*. It is thus possible to insert the ring 3 inside the tube 2 against the spring 5. The ring is displaced relative to the tube by a distance which is at least equal to the height 20*c* of the protuberances 2*c* (measured along the longitudinal axis A). In the fifth assembly step, the ring 3 is turned by an angle of approximately 60°, such as to allow the surfaces 2*a* and 3*a* to be positioned opposite one another. It is thus possible in the sixth assembly step (FIG. 8) to allow the ring 3 to be placed against the tube 2 under the presser effect of the spring 5.

An embodiment of a process for dismantling or removing a button is described hereinafter.

The process comprises the following steps:

applying an axial force F on the ring;

turning the ring relative to the tube by a fraction of a turn around the longitudinal axis A, in particular whilst maintaining the axial force;

releasing the axial force.

The dismantling of the ring 3 inside the tube 2 is thus carried out in a similar manner, by inverting the relative movements of the ring in relation to the tube. It should however be noticed that the step of "applying an axial force F on the ring" is optional, in particular with a button which does not comprise a lateral stop.

Figure 9:
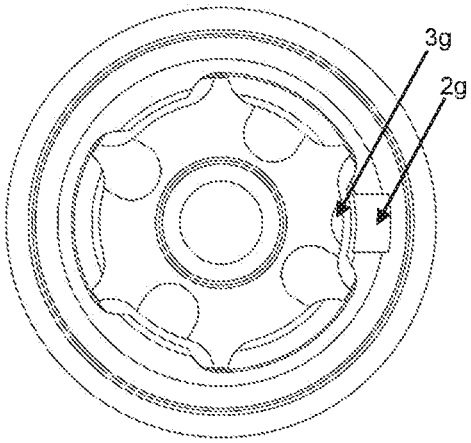
Figure 10:
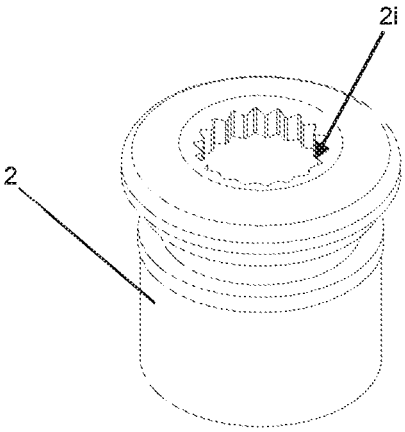
FIG. 10 is a view in perspective of the tube of the embodiment of the button.

In order to facilitate the fitting and/or dismantling, the ring and the tube have visual references or locating units. These references can comprise cut-outs 2*g* and 3*g*. These references make it possible to provide an indication of the angular position of the ring relative to the tube around the longitudinal axis A. For example, in the assembled configuration, these references 2*g* and 3*g* can coincide or be situated opposite one another, as represented in FIG. 9. These locating units make it possible to facilitate the control of the positioning of the ring 3 in the tube 2.

The button can be fitted on the middle in an assembled manner according to the aforementioned process for fitting or assembling the button, i.e. after having assembled the button according to the aforementioned process for fitting or assembly. Alternatively, only the tube can previously be fitted on the middle, in order then to proceed with assembly of the push button according to the aforementioned process for fitting or assembling the button.

The button as a whole can be dismantled from the middle before implementing the aforementioned process for dismantling or removing the button. Alternatively, only the tube can be dismantled from the middle, having previously proceeded with the dismantling of the push button according to the aforementioned process for dismantling or removing the button.

A solution of this type for assembling or dismantling the button, in particular a solution of this type for assembling or dismantling the ring 3 inside the tube 2, is particularly advantageous, in that the torque for retention in an angular position of the ring 3 is limited to a value which is substantially proportional to the presser force induced by the return spring 5. Thus, a solution of this type is particularly suitable for the implementation of a tube 2, which is connected to the middle 10 by means of a connection which can be dismantled. The torque for retention in an angular position of the ring 3 inside the tube 2 is in fact substantially less than the torque for unscrewing the tube. Thus, it is possible to dismantle the elements of the push button which are accommodated inside the tube without a risk of detracting from the connection between the tube and the middle, whilst proposing a tube 2, and thus a complete push button, which can be dismantled from the middle of the watch case.

Thanks to the button structure previously described, it is possible to remove easily the components ring 3, rod 4 and spring 5 from the tube 2 from the inside of the middle, within the context of an after-sales service operation. This makes it possible in particular to introduce a dismantling cone into the toothing 2*i* of the tube 2, in the case when the toothing is damaged, and/or can no longer receive the tool designed to actuate it conventionally.

The invention claimed is:

1. A button for a timepiece comprising:

a rod;

a tube adapted to guide the rod movable in the tube along a longitudinal axis;

a ring, wherein the rod is movable relative to the ring along the longitudinal axis;

a spring between the ring and the rod returning the rod to a position of rest;

and a mechanical connection between the ring and the tube, the mechanical connection being of the bayonet type, wherein the ring comprises at least one selected from the group consisting of (i) a bore adapted to guide the rod along the longitudinal axis, and (ii) a bearing surface adapted to provide a support for the spring returning the rod to a position of rest, and wherein the rod is extendable entirely through said ring and has a first end which is designed to interact with the user of the push button directly or by a tool and a second end opposite to said first end that is arranged to interact with a component of a movement of a timepiece.

2. The button as claimed in claim 1, wherein the spring is a helical spring.

3. The button as claimed in claim 1, wherein:

the mechanical connection comprises:

at least one protuberance extending radially on the tube relative to the longitudinal axis; and at least one housing in the ring so as to receive the at least one protuberance on the tube; and/or the mechanical connection comprises:

at least one protuberance extending radially on the ring relative to the longitudinal axis; and at least one housing in the tube so as to receive the at least one protuberance on the ring.

4. The button as claimed in claim 1, wherein the mechanical connection comprises at least one first axial stop, provided on the tube, and at least one second axial stop, provided on the ring, the first and second axial stops being designed to cooperate in the form of an obstacle in order to stop the ring in axial translation along the longitudinal axis relative to the tube.

5. The button as claimed in claim 1, wherein the mechanical connection comprises at least one first lateral stop provided on the tube, and at least one second lateral stop provided on the ring, the first and second lateral stops being designed to cooperate in a form of an obstacle in order to stop the ring in rotation according to the longitudinal axis, relative to the tube, in at least one direction of rotation.

6. The button as claimed in claim 5, wherein the at least one first lateral stop comprises at least one rim which extends along the longitudinal axis from a first axial stop, or wherein the at least one second lateral stop comprises at least one rim which extends along the longitudinal axis, from a second axial stop.

7. The button as claimed in claim 1, wherein the tube comprises three first axial stops each extending over an angular sector of between 30° and 50° around the longitudinal axis, and/or wherein the tube comprises three first axial stops distributed angularly regularly around the longitudinal axis, and/or wherein the ring comprises three second axial stops each extending over an angular sector of between 30° and 50° around the longitudinal axis, and/or wherein the ring comprises three second axial stops distributed angularly regularly around the longitudinal axis.

8. The button as claimed in claim 1, wherein the tube comprises an outer thread which is designed to allow the tube to be screwed into a middle, and/or wherein the tube comprises an annular groove for accommodation of a gasket, and/or wherein the tube comprises a shape designed to allow the tube to be rotated by a tool with a shape which is substantially complementary to the shape of the tube, and/or wherein the tube comprises at least one first guide surface, and the ring comprises at least one second guide surface, the first and second guide surfaces cooperating in order to guide the ring in the tube in sliding pivot connection.

9. The button as claimed in claim 1, wherein the ring comprises a face provided with at least one indentation designed to receive a tool for displacement of the ring relative to the tube.

10. A middle device of a watch case comprising the button as claimed in claim 1.

11. A watch case comprising the middle as claimed in claim 10.

12. A timepiece comprising the watch case as claimed in claim 11.

13. A process for fitting or assembling a button, the process comprising:

providing the rod, the tube adapted for guiding of the rod along a longitudinal axis and the spring;

providing the ring;

introducing the ring into the tube or the tube into the ring by exerting an axial force;

turning the ring relative to the tube by a fraction of a turn around the longitudinal axis; and releasing the axial force, so as to obtain the button as claimed in claim 1.

14. The process for fitting or assembling a button, the process comprising:

providing the tube adapted for guiding the rod along the longitudinal axis, the tube having the ring in the tube or on the tube;

turning the ring relative to the a by a fraction of a turn around the longitudinal axis; and releasing the axial force, so as to obtain the button as claimed in claim 1.

15. The process as claimed in claim 13, wherein the axial force opposes a force produced by the spring, and the turning of the ring is performed whilst maintaining the axial force.

16. The process as claimed in claim 14, wherein the turning of the ring is performed whilst applying the axial force.

17. The button as claimed in claim 2, wherein:

the mechanical connection comprises:

at least one protuberance extending radially on the tube relative to the longitudinal axis; and at least one housing in the ring so as to receive the at least one protuberance on the tube; and/or the mechanical connection comprises:

at least one protuberance extending radially on the ring relative to the longitudinal axis; and at least one housing in the tube so as to receive the at least one protuberance on the ring.

18. The button as claimed in claim 1, wherein the rod has a first bearing surface which is designed to constitute a support surface for the spring, and wherein the rod has a second bearing surface which is designed to cooperate with a bearing surface on the tube in order to stop the rod in translation along a longitudinal axis.

19. A button for a timepiece comprising:

a rod;

a tube adapted to guide the rod movable in the tube along a longitudinal axis;

a ring, wherein the rod is movable relative to the ring along the longitudinal axis;

a spring between the ring and the rod returning the rod to a position of rest; and a mechanical connection between the ring and the tube, the mechanical connection being of the bayonet type, wherein the ring comprises at least one selected from the group consisting of (i) a bore adapted to guide the rod along the longitudinal axis, and (ii) a bearing surface adapted to provide a support for the spring returning the rod to a position of rest, and wherein the rod has a first bearing surface which is designed to constitute a support surface for the spring, and wherein the rod has a second bearing surface which is designed to cooperate with a bearing surface on the tube in order to stop the rod in translation along a longitudinal axis.

* * * * *